US005451247A

United States Patent [19]

Gross et al.

[11] Patent Number: 5,451,247

[45] Date of Patent: Sep. 19, 1995

[54] PROCESS FOR REMOVING TIN, ARSENIC AND ANTIMONY FROM MOLTEN LEAD

[75] Inventors: Gerhard Gross, Willich; Dietmar Wibck, Toenisvorst; Karl Hengst; Frank Toubartz, both of Buchholz, all of Germany

[73] Assignee: Messer Griesheim GmbH, Germany

[21] Appl. No.: 271,013

[22] Filed: Jul. 6, 1994

[30] Foreign Application Priority Data

Jul. 8, 1993 [DE] Germany ..... 43 22 782.1

[51] Int. Cl.[6] ..... C22B 13/06

[52] U.S. Cl. ..... 75/699; 75/697

[58] Field of Search ..... 75/699, 697

[56] References Cited

U.S. PATENT DOCUMENTS 5,053,076 10/1991 Burany ..... 75/699

5,087,292 2/1992 Garrido ..... 75/699

*Primary Examiner*—Peter D. Rosenberg

*Attorney, Agent, or Firm*—Connolly & Hutz

[57] ABSTRACT

The invention relates to a process for removing tin, arsenic and antimony from molten lead by means of oxygen or oxygen-containing gas mixtures, which is or are blown into the molten lead by means of at least one gas nozzle (2). To avoid damage to the gas nozzle, at least the oxygen outlet region (13) thereof, located in the molten lead (6), is enveloped by an inert gas.

20 Claims, 1 Drawing Sheet

PROCESS FOR REMOVING TIN, ARSENIC AND ANTIMONY FROM MOLTEN LEAD

BACKGROUND OF THE INVENTION

The invention relates to a process and an apparatus for removing tin, arsenic and antimony from molten lead by means of oxygen or oxygen-containing gas mixtures, which is or are blown into the molten lead by means of at least one gas nozzle.

Various processes are already known for the refining of molten lead, in order to remove tin, arsenic and antimony.

The Harris process uses caustic soda and saltpetre as oxidizing agents. By means of a pump, the molten lead to be refined is pumped over into an intermediate vessel, the precipitated oxides being obtained in a salt slag. The slag then requires expensive further processing.

In the open-hearth process, air blown in is used for the oxidation. The resulting large quantities skimmed off at low antimony contents require expensive processing.

A refining process described in DE 3,327,796 Cl uses oxygen-enriched air in the melting vessel. In the process described, the rate of refining is limited by the lead temperature of 650° C. in the vessel. For slag formation, small quantities of caustic soda are added. Higher melting temperatures and working without caustic soda are possible in a refining process according to DE 3,831,898 Cl. In the process described, oxygen is introduced into a turbulent flow of molten lead, concentrated into a part volume relative to the melting vessel. The lead intimately mixed with oxygen enters a larger volume for relaxation, where the oxides float up and are skimmed off. The turbulent stream of lead is generated by a lead pump which delivers the lead into a reaction tube. The reaction tube is arranged in a second cylinder of larger volume, from which the oxides are taken off. The lead flows out through-an outlet orifice located at the bottom.

SUMMARY OF THE INVENTION

The application is based on the object of improving the process for removing tin, arsenic and antimony in such a way that high oxidation rates are achieved with an oxygen introduction system, without wear occurring on the gas nozzles.

By means of blowing the oxygen or an oxygen-containing gas mixture according to the invention in through one or more inert gas nozzles, the oxidation of the metals tin, arsenic and antimony can be accelerated and the equilibrium between impurities in the molten lead and in the skimmed dross can rapidly be established without damage to the gas nozzle, because the emerging oxygen or oxygen-containing gas mixture is enveloped by an inert gas at least in the outlet region. Thus, owing to the formation of a lead-free hollow space in front of the gas nozzle, the reaction site is displaced from the gas nozzle into the bath of molten lead. Contact between molten lead and the gas nozzle is avoided by the simultaneous formation of at least one inert gas cushion surrounding the outlet region. A further point is that the gas nozzle is cooled from the outside by the inert blanketing gas. The oxidation is additionally improved by the inert gas blown into the molten lead at high velocity, preferably sonic velocity, because the turbulent mixing of molten lead and oxygen is enhanced thereby.

Turbulent mixing of the oxygen and molten lead can also be adjusted via the oxygen emerging from the gas nozzle and the lead streamdelivered into a reaction vessel, the cooling inert gas then enveloping the gas nozzle in the form of circulation cooling. In this case, the inert gas nozzle does not have any outflow orifice but, instead, an inflow line and outflow line, through which the inert gas circulates in the gas nozzle, if desired cooled in an interposed heat exchanger. Cooling of the gas nozzle with a liquid such as water is also conceivable.

Advantageously, the gas nozzle is enveloped by the inert gas, which preferably is nitrogen, carbon dioxide or argon, from above the level of the molten lead down to the oxygen outlet region.

The oxides formed by the oxidation with oxygen segregate from the molten lead and float on the surface of the lead bath in a separate reaction vessel, from where they are taken off by controlling the lead level.

THE DRAWINGS

FIG. 1 illustrates an exemplary embodiment of the invention, namely lead refining by means of oxygen blown in.

DETAILED DESCRIPTION

Figure 2:
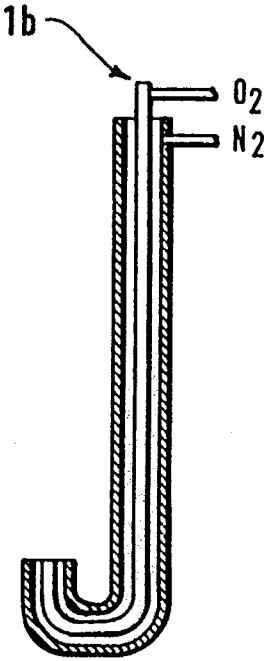
FIG. 2 illustrates an alternative form of nozzle.
Figure 1:
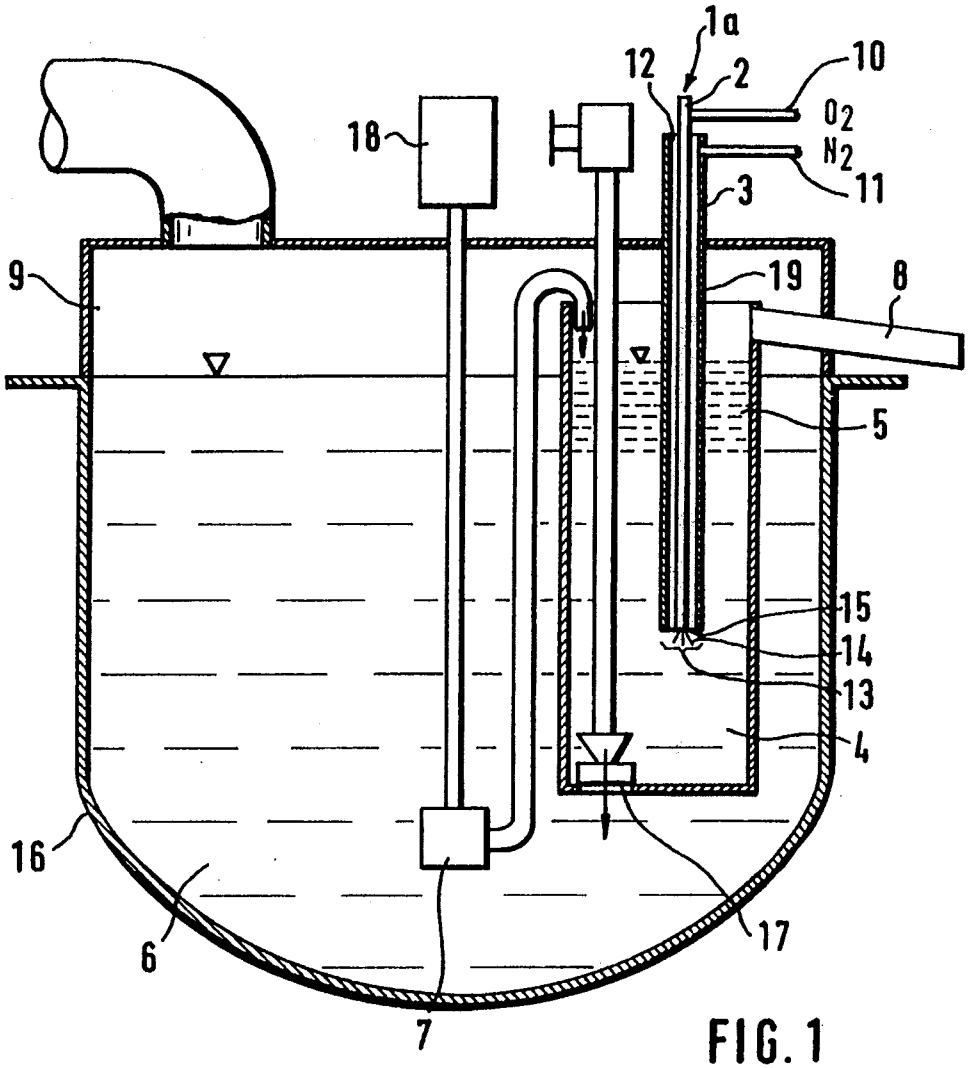

A gas nozzle 1*a* is shown which comprises an oxygen pipe 2 from which a jet 14 of gaseous oxygen or an oxygencontaining gas mixture emerges at high velocity and flows into the molten lead 6. Oxygen ($O_2$) is supplied through the feedline 10. The pipe 2 is concentrically surrounded by an outer pipe 3. An inert gas flows via the feedline 11 through the annular gap 12 formed between the pipe 2 and outer pipe 3 up to the outlet region 13 of the oxygen jet 14. The inert gas preferred is the inert gas nitrogen ($N_2$) or carbon dioxide ($CO_2$) or argon (Ar), because these gases can be made available inexpensively and do not react with the molten lead.

Preferably, the inert gas is also used as a mixed gas towards the end of the oxidation, i.e. nitrogen is admixed to the oxygen. In this way, the oxygen flow is adapted to the antimony content, when the antimony content then amounts to only a few hundred ppm, in order to prevent unduly extensive oxidation of lead. The antimony content in the reaction vessel 4 is determined by the residual content in the melt and in the pump line.

Towards the end of the process, the oxygen flow is reduced to such an extent that nitrogen is admixed to the oxygen in order to maintain the pressure upstream of the gas nozzle 1*a*.

The inert gas cooling the gas nozzle la flows from above the level of the molten lead down to the oxygen outlet region 13, emerges here from the nozzle orifice 15 and, forming a hollow space, flows into the molten lead 6. A gas cushion which, in conjunction with the hollow space, prevents contact between the molten lead being oxidized at high temperature and the pipes 2 and 3, is formed thereby on the end face of the inert gas nozzle 2, 3. In the exemplary embodiment shown, the pipe 2 for the oxygen and the outer pipe 3 for the inert gas extend in straight lines. The inert gas nozzle 2, 3 can also be designed in the form of a hooked gas nozzle which, in its outflow region, is directed towards the surface of the molten lead (FIG. 2) or it can be built directly into the melting vessel 16 or directly into the bottom of a reaction vessel 4.

The removal of tin, arsenic and antimony from the molten lead 6 takes place in a separate reaction vessel 4 in which the reaction products (skimmed dross) 5 collect on the surface of the molten lead 6. The lower part of the reaction vessel 4 dips into the molten lead 6 in the melting vessel 16. By means of a lead pump 7, the lead is delivered from the melting vessel from above into the reaction vessel 4 and, with turbulent mixing, comes into contact with the oxygen jet 14 blown in. The same quantity of lead as that pumped in from above returns at the bottom of the reaction vessel 4 via a closable orifice 17 into the melting vessel 16. As a result, the required intimate contact of the continuously circulating molten lead with the oxygen and a rapid reaction up to complete removal of tin, arsenic and antimony takes place.

Owing to large quantities of oxide, and in order to maintain an adequate quantity of lead above the nozzle, the refining is also interrupted for taking off the oxides. At this stage, the orifice 17 of the reaction vessel 4 is closed via a closing mechanism 18. For taking off the refining products tin, arsenic and antimony, the inert gas nozzle 2, 3 is withdrawn and the level of the molten lead in the reaction vessel 4 is increased by delivering lead, with the lead pump 7 running, from the melting vessel into the reaction vessel 4. The oxides can then be taken off via a chute 8.

The melting vessel 16 and the reaction vessel 4 are covered by extraction hoods 9 and are connected to a dust removal device.

We claim:

1. In a process for removing tin, arsenic and antimony from molten lead by means of oxygen or oxygen-containing gas mixtures blown into the molten lead from at least one oxygen gas nozzle, the improvement being in supplying an inert gas which does not react with the lead melt and flowing the inert gas along to oxygen nozzle to create an inert gas sheath at the oxygen nozzle outlet region in the molten lead, creating a hollow space in front of the oxygen nozzle by means of the inert gas sheath to prevent the lead melt from contacting the oxygen nozzle and to prevent oxidation directly at the oxygen nozzle whereby oxidation takes place remote from the nozzle.

2. The process as claimed in claim 1, wherein the gas nozzle is enveloped by the inert gas from above the level of the molten lead down to the oxygen outlet region.

3. The process as claimed in claim 2, wherein the inert gas emerges from a nozzle orifice and flows into the molten lead.

4. The process as claim to 3, wherein the inert gas is an inert cooling gas.

5. The process as claimed in claim 4, wherein the inert gas is nitrogen ( $N_2$) , carbon dioxide ( $CO_2$) or argon (Ar) .

6. The process as claimed in claim 5, wherein the inert gas flows at sonic velocity into the molten lead.

7. The process as claimed in claim 6, wherein the removal of tin, arsenic and antimony takes place in a separate reaction vessel from which the reaction products floating on the surface of the molten lead are taken off by controlling the lead level.

8. An apparatus for carrying out the process as claimed in claim 7, having a feedline for oxygen or an oxygen-containing gas mixture and a gas nozzle connected to the feedline, wherein the gas nozzle is surrounded by an inert gas nozzle.

9. The apparatus as claimed in claim 8, wherein the gas nozzle comprises a pipe which is surrounded by an outer pipe to form a channel and the channel is connected to an inert gas feedline.

10. The apparatus as claimed in claim 9, wherein the pipes are arranged concentrically.

11. The apparatus as claimed in claim 8, wherein the pipes are arranged concentrically.

12. An apparatus for carrying out the process as claimed in claim 1, having a feedline for oxygen or an oxygen-containing gas mixture and a gas nozzle connected to the feedline, wherein the gas nozzle is surrounded by an inert gas nozzle.

13. The apparatus as claimed in claim 12, wherein the gas nozzle comprises a pipe which is surrounded by an outer pipe to form a channel and the channel is connected to an inert gas feedline.

14. The apparatus as claimed in claim 13, wherein the pipes are arranged concentrically.

15. The process as claimed in claim 1, wherein the inert gas emerges from a nozzle orifice and flows into the molten lead.

16. The process as claimed in claim 1 wherein the inert gas is an inert-cooling gas.

17. The process as claimed in claim 1, wherein the inert gas is nitrogen ($N_2$), carbon dioxide ($CO_2$) or argon (Ar).

18. The process as claimed in claim 1, wherein the inert gas flows at sonic velocity into the molten lead.

19. The process as claimed in claim 1, wherein the removal of tin, arsenic and antimony takes place in a separate reaction vessel from which the reaction products floating on the surface of the molten lead are taken off by controlling the lead level.

20. The process as claimed in claim 1, wherein the inert gas is an inert cooling gas.

* * * * *